US010704831B2

(12) United States Patent
Mak

(10) Patent No.: US 10,704,831 B2
(45) Date of Patent: Jul. 7, 2020

(54) SYSTEMS AND METHODS FOR FLEXIBLE PROPANE RECOVERY

(71) Applicant: Fluor Technologies Corporation, Sugar Land, TX (US)

(72) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 0 days.

(21) Appl. No.: 15/985,813

(22) Filed: May 22, 2018

(65) Prior Publication Data

US 2018/0266756 A1 Sep. 20, 2018

Related U.S. Application Data

(63) Continuation of application No. 14/587,842, filed on Dec. 31, 2014, now Pat. No. 9,989,305.

(Continued)

(51) Int. Cl.

*F25J 3/00* (2006.01)
*F25J 3/02* (2006.01)

(Continued)

(52) U.S. Cl.

CPC ..... *F25J 3/0209* (2013.01); *C10G 5/06* (2013.01); *F25J 3/0233* (2013.01); *F25J 3/0238* (2013.01); *F25J 3/0242* (2013.01); *C10L 3/101* (2013.01); *C10L 3/12* (2013.01); *C10L 2290/06* (2013.01); *C10L 2290/46* (2013.01); *C10L 2290/48* (2013.01); *C10L 2290/543* (2013.01); *F25J 2200/04* (2013.01); *F25J 2200/70* (2013.01);

(Continued)

(58) Field of Classification Search

CPC ..... F25J 3/0209; F25J 3/0238; F25J 3/0242; F25J 2200/72; F25J 2200/74; F25J 2200/76; F25J 2205/04; F25J 2215/62; F25J 2215/64; F25J 2240/40

See application file for complete search history.

(56) References Cited

U.S. PATENT DOCUMENTS 4,061,481 A 12/1977 Campbell et al.
5,588,308 A * 12/1996 Daugherty ..... F25J 3/0209 62/622

(Continued)

FOREIGN PATENT DOCUMENTS

CA 2935851 A1 7/2015
EP 1554532 A1 7/2005

(Continued)

OTHER PUBLICATIONS

Office Action dated Mar. 21, 2017, U.S. Appl. No. 14/587,842, filed Dec. 31, 2014.

(Continued)

*Primary Examiner* — Keith M Raymond
(74) *Attorney, Agent, or Firm* — Conley Rose, PC

(57) ABSTRACT

Systems and methods that utilize feed gases that are supplied in a wide range of compositions and pressure to provide highly efficient recovery of NGL products, such as propane, utilizing isenthalpic expansion, propane refrigeration, and shell and tube exchangers are described. Plants utilizing such systems and methods can be readily reconfigured between propane recovery and ethane recovery.

20 Claims, 6 Drawing Sheets

Related U.S. Application Data

(60) Provisional application No. 62/028,158, filed on Jul. 23, 2014, provisional application No. 61/923,095, filed on Jan. 2, 2014.

(51) Int. Cl.
*C10G 5/06* (2006.01)
*C10L 3/12* (2006.01)
*C10L 3/10* (2006.01)

(52) U.S. Cl.
CPC ..... *F25J 2200/78* (2013.01); *F25J 2205/04* (2013.01); *F25J 2220/64* (2013.01); *F25J 2220/66* (2013.01); *F25J 2230/30* (2013.01); *F25J 2230/60* (2013.01); *F25J 2240/40* (2013.01); *F25J 2245/02* (2013.01); *F25J 2270/02* (2013.01); *F25J 2270/12* (2013.01); *F25J 2270/60* (2013.01); *F25J 2280/02* (2013.01)

(56) References Cited

U.S. PATENT DOCUMENTS

| | | | | |
|---|---|---|---|---|
| 5,685,170 | A | 11/1997 | Sorensen | |
| 6,823,692 | B1 * | 11/2004 | Patel | F25J 3/0209 62/620 |
| 6,931,889 | B1 | 8/2005 | Foglietta et al. | |
| 7,051,522 | B2 | 5/2006 | Yang et al. | |
| 8,590,340 | B2 | 11/2013 | Pitman et al. | |
| 2003/0136146 | A1 | 7/2003 | Fischer-Calderon et al. | |
| 2004/0148964 | A1 * | 8/2004 | Patel | C07C 7/005 62/620 |
| 2004/0206112 | A1 * | 10/2004 | Mak | F25J 3/0209 62/617 |
| 2004/0250569 | A1 | 12/2004 | Mak | |
| 2004/0261452 | A1 * | 12/2004 | Mak | F25J 3/0209 62/620 |
| 2005/0255012 | A1 | 11/2005 | Mak | |
| 2008/0271480 | A1 | 11/2008 | Mak | |
| 2009/0308101 | A1 | 12/2009 | Mak | |
| 2010/0206003 | A1 | 8/2010 | Mak | |
| 2011/0067441 | A1 * | 3/2011 | Martinez | F25J 3/0209 62/620 |
| 2014/0182331 | A1 * | 7/2014 | Burmberger | F25J 1/004 62/630 |
| 2014/0202207 | A1 | 7/2014 | Malik | |
| 2015/0184931 | A1 | 7/2015 | Mak | |

FOREIGN PATENT DOCUMENTS

| | | |
|---|---|---|
| WO | WO2003062724 | 7/2003 |
| WO | WO2015103403 A1 | 7/2015 |

OTHER PUBLICATIONS

Final Office Action dated Aug. 7, 2017, U.S. Appl. No. 14/587,842, filed Dec. 31, 2014.

Advisory Action dated Oct. 19, 2017, U.S. Appl. No. 14/587,842, filed Dec. 31, 2014.

Notice of Allowance dated Feb. 7, 2018, U.S. Appl. No. 14/587,842, filed Dec. 31, 2014.

Foreign Communication from a Related Counterpart—International Search Report and Written Opinion, dated Mar. 13, 2015, PCT/US2014/073019, filed on Dec. 31, 2014.

Foreign Communication from a Related Counterpart—International Preliminary Report on Patentability, dated Jul. 14, 2016, PCT/US2014/073019, filed on Dec. 31, 2014.

Mak, John, "Methods and Configurations for Flexible Propane Recovery Processes," U.S. Appl. No. 61/923,095, filed Jan. 2, 2014.

Mak, John, "Configurations and Methods of Flexible Propane Recovery Processes," U.S. Appl. No. 62/028,158, filed Jul. 23, 2014.

Notice of Decision dated Feb. 27, 2020, United Arab Emirates Application No. P6000006/16 filed on Jan. 2, 2014.

* cited by examiner

| Stream | 1 | 16 | 17 | 34 | 40 | 39 |
|---|---|---|---|---|---|---|
| Description | Feed Gas | C5+ Condensate | NGL from Stabilizer | NGL from NGL Recovery | Total NGL | Sales Gas |
| $CO_2$ | 1.64 | 0.00 | 0.00 | 0.00 | 0.00 | 1.83 |
| $N_2$ | 1.04 | 0.00 | 0.00 | 0.00 | 0.00 | 1.17 |
| C1 | 71.89 | 0.00 | 0.00 | 0.00 | 0.00 | 80.34 |
| C2 | 14.44 | 0.00 | 0.75 | 0.54 | 0.59 | 16.07 |
| C3 | 7.99 | 0.00 | 39.49 | 71.23 | 63.20 | 0.59 |
| iC4 | 0.92 | 0.00 | 13.06 | 8.78 | 9.86 | 0.00 |
| nC4 | 1.55 | 0.09 | 31.81 | 14.75 | 19.07 | 0.00 |
| iC5 | 0.26 | 14.17 | 9.90 | 2.49 | 4.36 | 0.00 |
| nC5 | 0.18 | 31.33 | 4.93 | 1.72 | 2.53 | 0.00 |
| nC6+ | 0.09 | 54.42 | 0.06 | 0.50 | 0.39 | - |
| Pressure, psia | 610 | 133 | 130 | 453 | 130 | 615 |
| Temperature, °F | 95 | 286 | 118 | 202 | 107 | 143 |
| Flow lbmole/hr | 13,153 | 109 | 467 | 1,381 | 1,848 | 11,770 |

FIG. 4

| Stream | 1 | 16 | 17 | 34 | 40 | 39 |
|---|---|---|---|---|---|---|
| Description | Feed Gas | C5+ Condensate | NGL from Stabilizer | NGL from NGL Recovery | Total NGL | Sales Gas |
| $CO_2$ | 1.39 | 0.00 | 0.00 | 0.00 | 0.00 | 1.50 |
| $N_2$ | 0.89 | 0.00 | 0.00 | 0.00 | 0.00 | 0.96 |
| C1 | 82.73 | 0.00 | 0.00 | 0.00 | 0.00 | 88.99 |
| C2 | 7.09 | 0.00 | 0.91 | 0.56 | 0.62 | 7.59 |
| C3 | 4.50 | 0.00 | 25.51 | 51.71 | 47.24 | 0.95 |
| iC4 | 0.96 | 0.01 | 15.15 | 13.63 | 13.89 | 0.01 |
| nC4 | 1.72 | 0.14 | 39.24 | 24.47 | 26.99 | 0.01 |
| iC5 | 0.34 | 15.80 | 12.57 | 4.88 | 6.19 | 0.00 |
| nC5 | 0.25 | 29.06 | 6.46 | 3.55 | 4.05 | 0.00 |
| nC6+ | 0.12 | 55.00 | 0.15 | 1.19 | 1.01 | - |
| Pressure, psia | 745 | 133 | 130 | 453 | 130 | 615 |
| Temperature, °F | 95 | 286 | 134 | 224 | 127 | 165 |
| Flow lbmole/hr | 13,452 | 84 | 193 | 942 | 1,135 | 12,506 |

FIG. 5

SYSTEMS AND METHODS FOR FLEXIBLE PROPANE RECOVERY

CROSS REFERENCE TO RELATED APPLICATIONS

This application is a continuation of U.S. patent application Ser. No. 14/587,842, filed on Dec. 31, 2014, entitled "Systems and Methods for Flexible Propane Recovery", which claims priority to U.S. Provisional Application 61/923,095 filed on Jan. 2, 2014, entitled "Methods and Configurations for Flexible Propane Recovery" and priority to U.S. Provisional Application No. 62/028,158 filed on Jul. 23, 2014, entitled "Methods and Configurations for Flexible Propane Recover," all of which are incorporated herein by reference in their entirety.

FIELD OF THE INVENTION

The field of the invention is propane recovery, particularly propane recovery from lean gas mixtures.

BACKGROUND

The following description includes information that may be useful in understanding the present invention. It is not an admission that any of the information provided herein is prior art or relevant to the presently claimed invention, or that any publication specifically or implicitly referenced is prior art.

Various processes are known for natural gas liquids (NGL) recovery, and especially for the recovery of propane from high pressure feed gas. At a minimum, hydrocarbon content must be sufficient to meet hydrocarbon dewpoint specifications for pipeline transmission. This generally requires installation of a dewpointing unit that includes a gas-gas exchanger and a refrigeration chiller, and frequently includes ethylene glycol injection exchangers. Ethylene glycol injection typically operates at close to −29° C. (−20° F.), primarily due to the technical challenges of phase separation at lower temperatures. Consequently the propane (i.e. C3) recovery of a dewpointing unit is limited to 30% to 50%, depending upon the feed gas composition.

Liquid products (such as liquid propane) have high value, and there are significant economic incentives to recover C3 as efficiently as possible. As a result there are a number of recovery processes for natural gas liquids (NGL) that utilize a variety of arrangements of heat exchangers, multiple columns, turbo expanders, and complex reflux schemes. The use of turbo expanders and plate fin heat exchangers are currently accepted as standard equipment for NGL recovery unit designs, as shown in U.S. Pat. No. 4,061,481 (to Campbell et al), U.S. Pat. No. 8,590,340 (to Pitman et al), U.S. Pat. No. 7,051,522 (to Mak), and United States Patent Application Publication No. 2005/0,255,012 (to Mak). All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply. Such plants typically utilize a refluxed absorber operating at low temperatures (at least −51° C. or −60° F.), which are generated using a turbo-expander that reduces the pressure of a chilled, high pressure gas. While effective (producing propane yields of up to 99%), such turbo-expanders are complex devices that represent a significant capital investment and require significant lead time.

Such processes can achieve high C3 recovery, but can only do so if the feed gas flow rate and composition does not deviate significantly from the conditions for which the plant was designed. If there are significant differences from design conditions (for example, suboptimal pressure, suboptimal flow rates, and/or excessively lean gas composition) process inefficiencies can result. For example, if the supplied gas has a leaner composition than is nominal and is supplied at a lower pressure, the brazed aluminum exchangers typically used in such processes can encounter temperature pinches that result in reduced recovery and lower plant throughput. In such a situation the low feed gas pressure reduces the expansion ratio of the turbo-expanders, resulting in reduced cooling effects and lower C3 recovery. Lean gas composition can be caused by upstream nitrogen injection activities used to enhance oil recovery. Typically, leaner gas will lower the temperature profile in the gas chillers, which can exceed the design limits of existing equipment and cause a safety issue. Safe processing of high nitrogen content gas in an existing plant typically requires the use of an expander bypass valve (due to expander capacity limitations), which reduces C3 recovery and plant throughput. In most instances, in order to maintain high C3 recovery under such conditions the impeller of the expander (or in some instances the entire expander) must be replaced. This is not always feasible in small or remote facilities, where supplies and labor may not be readily available.

Typical NGL recovery units utilize brazed aluminum exchangers which can achieve close temperature approaches (less than 4° F.) and high heat transfer efficiency. Such heat exchangers are compact in design and are low in cost (per square foot of heat transfer area) compared to shell and tube exchangers, and have seen widespread adoption in NGL plants. Brazed aluminum exchangers, however, are prone to fouling and damage from mechanical and thermal stress. Aluminum is also a relatively reactive metal and will form amalgams with mercury, even with mercury concentrations in the ppm range. This results in material fatigue and corrosion. In most NGL plants, a mercury removal bed is installed upstream from the NGL recovery unit to protect such aluminum equipment. Aluminum is also prone to thermal stress from high operating temperature, sudden temperature changes, and/or high temperature differentials. A typical aluminum exchanger cannot be operated above 150° F. and temperature differentials between heat exchanger passes must be less than 50° F. Exposure to high temperatures weakens aluminum welds and will result in exchanger failure. As a result, plants utilizing brazed aluminum exchangers require significant operator attention, particularly during startup, shutdown, or whenever temperature excursion is likely.

Almost in all cases, high propane recovery plants require brazed aluminum exchangers and turbo-expander integrated with complex heat exchange configurations, multiple columns and various refluxes. Such brazed aluminum exchangers are prone to stress failure, and while turbo-expander(s) can be utilized to improve recovery efficiency and reduce energy consumption, optimal performance of such devices is limited to the design flow rate. Rotating equipment such as the expander-compressors used in current NGL recovery processes is limited to a turndown rate of approximately 60%. Below this turndown rate, the expander has to be shut down, and the unit operated in a JT valve (i.e. bypass) mode. Under such circumstances NGL recovery is significantly reduced.

In current shale gas exploration the resulting feed gas compositions and flow rates are uncertain. As a result there are inherent design difficulties with the traditional plant designs for NGL recovery from such sources. To accommodate these uncertainties typical mid-stream processors are forced to employ multiple turbo-expander units to accommodate the inevitable variations in turndown gas flow and gas composition. While such an approach can achieve basic process requirements, the use of multiple turbo-expander units significantly increases design complexity, capital costs, and maintenance requirements.

Current high C3 recovery processes, with their high equipment counts and requirement for experienced and highly skilled staff, are not a suitable choice for shale-gas NGL plants or plants located in remote locations. While numerous attempts have been made to improve the efficiency and economy of processes for separating and recovering ethane, propane, and heavier natural gas liquids from natural gas and other sources, all or almost all of them suffer from one or more disadvantages. Most significantly, heretofore known configurations and methods are configured for very high C3 recovery with complex design.

Thus there remains a need for simple and robust systems and methods that permit highly efficient recovery of C2 and C3 NGL fractions when supplied with a broad range of feed gas compositions and pressures.

SUMMARY OF THE INVENTION

The inventive subject matter provides apparatus, systems and methods that provide highly efficient recovery of NGL products, including propane and ethane, from both rich and lean feed gases. Systems of the inventive concept utilize isenthalpic expander, such as Joule-Thompson valves, and propane refrigeration to reduce process stream temperatures, and can utilize simple tube and shell heat exchangers. As a result, such systems can be prepared with relatively little lead time, are easily modularized, and require a minimum of maintenance during operation. Using such methods propane recovery from the feed gas can exceed 85%. In some embodiments propane recovery can exceed 95%. In addition, plants incorporating such systems and/or methods can readily switch between propane production and ethane production.

One embodiment of the inventive concept is a method of processing a feed gas stream. Such a method includes cooling the feed gas stream to produce a cooled feed gas stream, segregating the cooled feed gas into a vapor fraction and a liquid fraction, separating the vapor fraction from the liquid fraction, expanding the liquid fraction using an isenthalpic process (for example using a Joule-Thompson valve) to provide cooling to the feed gas and form an expanded liquid fraction; expanding the vapor fraction in an isenthalpic fashion (for example using a Joule-Thompson valve) to form an expanded vapor fraction; and applying the expanded vapor fraction to a fractioning column (for example a deethanizer) to produce a C3+ product (which is recovered as a propane product) and an overhead product. At least part of the expanded vapor fraction and the overhead product are transferred to an absorber. The absorber and the fractioning column are operated at a pressure of between 200 psig to 500 psig. In some embodiments the stream of feed gas and/or the vapor fraction are cooled using propane refrigeration. In other embodiments cooling is accomplished using a shell tube heat exchanger. Feed gas is applied at an initial pressure of at least 100 psia, cooled at a pressure ranging from 500 psia to 1200 psia, and expanded at a pressure ranging from 300 psig to 500 psig. In still other embodiments the method described above for propane (C3) recovery can be switched to an ethane (C2 or C2+ liquid) recovery mode by rerouting the overhead product recovered from the fraction column/deethanizer to the bottom of the absorber. In such an embodiment the liquid fraction is a C2+ enriched liquid fraction and the vapor fraction is a C2+ depleted vapor fraction when the method is operated in ethane recovery mode; similarly the liquid fraction is a C3+ enriched liquid fraction and the vapor fraction is a C3+ depleted vapor fraction when the method is operated in propane recovery mode.

Some embodiments include the additional step of separately expanding the vapor fraction and liquid fraction, with the vapor portion expanded using a Joule-Thomson valve prior to transfer to the absorber during propane recovery, and, optionally, divided into a first portion and a second portion with the first portion routed to the absorber subcooler to form a methane rich reflux to the absorber during ethane recovery operation. Still other embodiments include the additional step of cooling the overhead product by propane refrigeration and diverting at least part the cooled overhead product to provide at least part of reflux of the fractioning column during propane recovery operation and rerouting the overhead produce directly to the bottom of the absorber bottom ethane recovery operation while bypassing the overhead product cooling step. In such an embodiment the reflux has a temperature between −34° C. (−30° F.) to −57° C. (−70° F.) during propane recovery, and a temperature between −51° C. (−60° F.) to −73° C. (−100° F.) during ethane recovery.

In another embodiment of the inventive concept, an additional heat exchanger is provided that receives a cold stream from the bottom of the absorber. This heat exchanger is used to provide further cooling (for example, in addition to propane refrigeration) of the overhead stream from the fractioning column prior to transfer of this stream to the top portion of the absorber. Such an embodiment provides improved propane recovery relative to methods of the inventive concept that do no incorporate this additional cooling.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 4 is a table showing the composition of various intermediate and product streams in a system of the inventive concept.

FIG. 5 is a table showing the composition of various intermediate and product streams in a system of the inventive concept.

DETAILED DESCRIPTION

Figure 1:
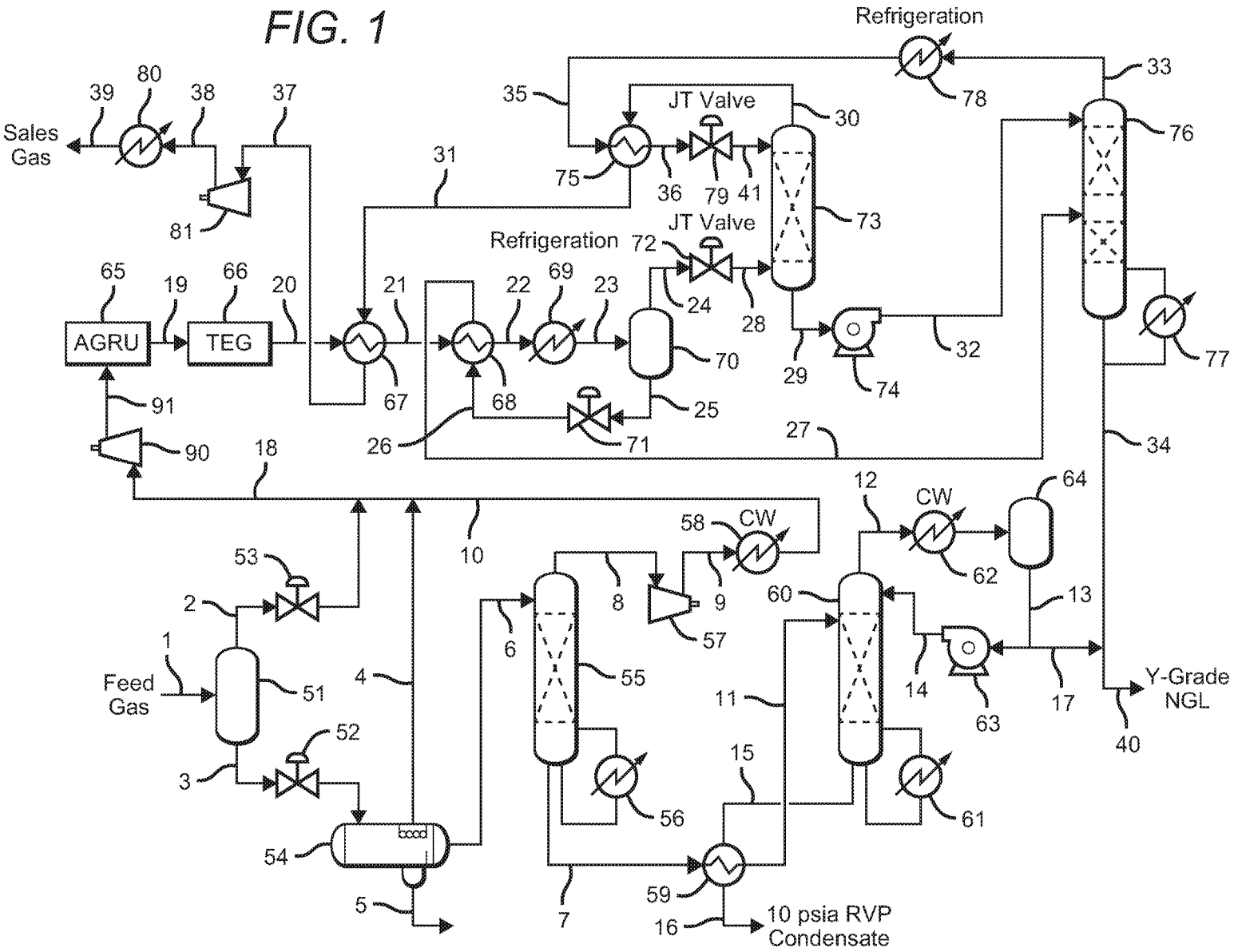
FIG. 1 schematically depicts a system of the inventive concept, configured for recovery of propane.

The following description includes information that may be useful in understanding the present invention. It is not an admission that any of the information provided herein is prior art or relevant to the presently claimed invention, or that any publication specifically or implicitly referenced is prior art.

The inventor has found, surprisingly, that feed gas at any pressure can be processed in configurations and methods that employ feed gas compression, propane refrigeration, and expansion of the chilled feed gas (for example, in a Joule-Thompson valve) to an absorber to provide highly efficient (i.e. ≥85%) recovery of propane or ethane (depending upon plant configuration) without the use of turbo expanders. Plants of the inventive concept can also be readily switched between propane recovery and ethane recovery modes. Such a process can reduce the temperature of the feed gas to a degree sufficient for condensation of a portion of the feed gas into a C3+ depleted vapor and a C2+ enriched liquid, which can be separated to produce a C3+ liquid product and a C2 enriched vapor that can advantageously be used a reflux to the absorber.

It should be appreciated that the contemplated methods do not require the use of turbo-expanders and brazed aluminum heat exchangers as is typical of conventional methods. Consequently they are more robust in operation, capable of high flow turndown, and lower in plant costs. This is particularly true for small Natural Gas Liquid (NGL) plants (i.e., 200 MMscfd or less). Most typically, contemplated plant configurations and methods achieve propane recovery in the range of 70%, 75%, 80%, 85%, 90%, 95%, or more than 95% of the propane available in the feed gas while having a lower specific energy consumption than prior art NGL processes. Moreover, it should be appreciated that most of the cooling duties can be provided by propane refrigeration and by expansion (for example through the use of one or more Joule-Thomson valves). While it is preferred that volume is expanded and/or pressure is reduced in an isenthalpic expansion device such as a Joule-Thomson valve, alternative isenthalpic expansion devices (for example, expansion nozzles) can be used. It should be appreciated that systems and methods of the inventive concept achieve high (i.e. ≥85%) recovery but do not require the use of turbo-expander/compressor, and can use simple and robust shell and tube heat exchangers rather than the brazed aluminum exchangers of conventional high recovery methods. Such shell and tube exchangers are more durable and forgiving in operation than brazed aluminum exchangers. Since they are constructed from stainless steel or carbon steel, shell and tube heat exchangers do not react with mercury and can withstand thermal excursion.

Advantageously, systems and processes of the inventive concept can be adapted for ethane recovery with only relatively minor changes in the flow of product streams (which can be accomplished with minor additional piping and valving), and can recover 40, 60%, 80%, 85%, 90%, 95%, or more than 95% of the available ethane. As a result embodiments of the inventive concept can enable gas processors to preserve the capability of mid-range ethane recovery while maintaining high propane recovery if, for example, they are required to export ethane as a product for petrochemical production.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Preferred embodiments of the inventive concept are directed to plant configurations and methods that are used to recover from 80% to 95% of propane in feed gases based on a two column configuration, in which a feed gas is first separated, for example using an inlet separator, to produce a vapor stream that is compressed, treated, and dried prior to being cooled by propane refrigeration. This vapor stream can be further separated to produce a chilled vapor that is subsequently reduced in pressure by an isenthalpic process, for example by using a Joule-Thomson (JT) valve, nozzle, capillary, and/or other throttling device. This chilled vapor can be directed to an absorber, which generates a C3+ depleted overhead fraction and a C2+ enriched bottom fraction. The C2+ enriched bottom fraction can be processed in a fractionating column (for example a non-refluxed deethanizer) that generates a C3+ NGL product and an overhead C2 enriched vapor. This C2 enriched vapor can be cooled, for example by propane refrigeration and/or an overhead gas cooler, to produce a cold lean reflux that is directed to the absorber. In some embodiments, a liquid stream from the inlet separator is first separated (for example, in a feed liquid stripper) to provide an ethane depleted liquid that is further fractionated (for example, in a stabilizer) to produce a C3+ overhead liquid and a condensate bottom product. Such a condensate bottom product can have a Reid Vapor Pressure (RVP) of about 10 psia.

In preferred embodiments of the inventive concept, shell and tube exchangers are used in chillers and as heat exchangers in order to ensure robust operation that is essential for operating NGL plants or plants in remote locations. In some embodiments of the inventive concept, JT valves are used to generate deep chilling. This advantageously permits adaptation of the process to various feed gases (such as those with high nitrogen content) and high turndown flow, while maintaining high C3 recovery. As shown in FIG. 4 and FIG. 5, the systems and processes of the inventive concept can achieve 95% C3 recovery for rich gas and 85% C3 recovery for lean gas, despite their differing compositions.

Another embodiment of the inventive concept is a method for ethane recovery that reroutes a deethanizer overhead vapor to the bottom or a lower portion of an absorber to absorb the ethane component of the feed gas. This can be coupled with a split flow arrangement in the feed section to provide a methane rich subcooled liquid to absorb the resulting ethane. Such an embodiment can provide recovery of 40 to 60% or more of the available ethane.

One should appreciate that the disclosed methods and configurations provide many advantageous technical effects, including reduced equipment counts, simple operation, improved tolerance for variation in the composition, flow rate, and pressure of the feedstock, increased flexibility in product delivery, and improved robustness and durability relative to prior art turbo-expander plants, while maintaining high recovery of propane and/or ethane products. These are important considerations, particularly for small and/or remotely located plants, where skilled labor and resources are typically in short supply. In addition, without the need to factor in the use of long lead time items utilized in manufacturing turbo-expanders and brazed aluminum exchangers, an NGL plant of the inventive concept can be engineered, modularized, and delivered to a plant site in a time frame that is not achievable using conventional approaches. Various objects, features, aspects and advantages of the inventive subject matter will become more apparent from the following description of various embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, the term "about" in conjunction with a numeral refers to a range of that numeral starting from 20% below the absolute of the numeral to 20% above the absolute of the numeral, inclusive. For example, the term "about −50° F." refers to a range of −30° F. to −70° F., and the term "about 600 psig" refers to a range of 400 psig to 800 psig. The term "C2+ enriched" or "C3+ enriched" liquid, vapor, or other fraction as used herein refers to a liquid, vapor, or other fraction that has a higher molar fraction of C2 or heavier (for C2+ enriched), or C3 or heavier (for C3+ enriched) components than the liquid, vapor, or other fraction from which the C2+ enriched or C3+ enriched liquid, vapor, or other fraction is derived. Similarly, the term "C2+ depleted" or "C3+ depleted" liquid, vapor, or other fraction as used herein means that the liquid, vapor, or other fraction has a lower molar fraction of C2, C3 (respectively), and/or heavier components than the liquid, vapor, or other fraction from which the C2+ depleted or C3+ depleted liquid, vapor, or other fraction is derived. The term "C2+" as used herein refers to ethane and heavier hydrocarbons. The term C3+ as used herein refers to propane and heavier hydrocarbons.

FIG. 1 depicts an exemplary system of the inventive concept, where the feed gas stream 1, typically at about 4° C. to 49° C. (40° F. to 120° F.), and about 400 to 800 psig, is separated in an inlet separator 51 to form a vapor stream 2 and a liquid stream 3. The liquid stream 3 is passed through a JT valve 52 and then further reduced in pressure in a separator 54, which generates a water stream 5 and a hydrocarbon stream 6 from the liquid stream 3, along with a vapor stream 4. The hydrocarbon stream 6 can be further processed in a feed liquid stripper 55. The feed liquid stripper 55 is used with a reboiler 56 and typically operates at about 150 to 400 psia, and generates a C2 depleted bottom fraction 7 and a C2 rich vapor stream 8 from the hydrocarbon stream 6. The C2 rich vapor stream 8 can be compressed using a compressor 57 to produce stream 9, which is then cooled in an exchanger 58 to 27° C. to 49° C. (80° F. to 120° F.), forming a recycle stream 10. The recycle stream 10 can be combined with the vapor stream 2 from the inlet separator 51 (and after the passage of vapor stream 2 through a JT valve 53) to form a mixed stream 18, which is compressed by a feed compressor 90 to 600 to 800 psig, forming a compressed vapor stream 91 that can be transferred to an Acid Gas Removal Unit (AGRU) 65 for removal of acid gas (for example, $CO_2$ and/or $H_2S$) content and other contaminants to produce stream 19. Stream 19 can be dehydrated in a tetraethyleneglycol (TEG) water removal unit 66 to produce stream 20.

The C2 depleted liquid bottom fraction 7 can be heated in a heat exchanger 59 by a stabilizer bottom stream 15 to about 60° C. to 90° C. (140° F. to 200° F.), forming a stream 11 which can be reduced in pressure to about 90 to 150 psia and transferred to a stabilizer 60. The stabilizer 60 can be heated with a reboiler 61, and fractionates stream 11 into a C3+ NGL overhead fraction 12 and the C5+ condensate bottom fraction 15. As noted above, the condensate bottom fraction 15 can be utilized in a heat exchanger 59. This generates a 10 psia RVP condensate stream 16. The C3+ NGL overhead fraction 12 can be cooled by cooling water (CW) and/or ambient air in a heat exchanger 62 and separated in a separator 64 to form a C3+NGL liquid stream 13, a portion of which can be transferred to the stabilizer using a pump 63 as stream 14 for use as reflux, with the remaining portion 17 forming at least part of an NGL product stream 40. The portion of the C3+ NGL liquid stream 13 that is diverted for use as reflux can range from 20% to 90% of the flow.

As noted above, a compressed vapor stream 91 (600 to 900 psig) can be treated in an AGRU Unit 65 for removal of acidic contaminants (for example $CO_2$ and $H_2S$) and further dried in a tetraethyleneglycol (TEG) Unit 66 for removal of water content to produce stream 20. The TEG dehydration process can be configured for varying degrees of water removal, for example water removal sufficient to meet a water dewpoint of about −80 to −110° F., in order to accommodate the needs of downstream equipment. The dried vapor 20 can be cooled using a residue gas stream 31 in a heat exchanger 67 to about −12° C. to 4° C. (10° F. to 40° F.) to generate a stream 21, and can be further cooled by a JT liquid stream 26 in a heat exchanger 68 to about 5 to 25° F., forming stream 22. The dried and cooled stream 22 can be subsequently chilled using propane refrigeration in a heat exchanger 69 to from about −37° C. (−35° F.) to about −41° C. (−42° F.), forming a mixed stream 23 that can be separated in a separator 70 to produce a vapor stream 24 and a liquid steam 25. The liquid stream 25 can be reduced in pressure, for example using a JT valve 71, to produce a stream 26 that provides at least a portion of the cooling duty in a heat exchanger 68. The resulting stream 27 can be directed to a fractionation column 76 for further processing.

The vapor stream 24 can be reduced in pressure, for example in a JT valve 72, to a reduced pressure of about 300 psia to about 500 psia, and chilled to about −46° C. (−50° F.) to about −51° C. (−60° F.) to produce a stream 28. In a preferred embodiment the reduced pressure of vapor stream 28 is about 415 psia. While the letdown pressure is typically 415 psia, it can range from about 300 psia to about 500 psia, depending on the feed gas composition and/or the desired level of C3 recovery. The C3 content in stream 28 can be absorbed by a cold reflux stream 41 that is provided by a fractionation column 76 (for example, a deethanizer).

The fractionation column bottom stream 29 can transferred by a pump 74 to form stream 32, which is directed to a deethanizer 76. Deethanizer 76 can be a non-refluxed column (for example, a stripper) that is heated with a reboiler 77, producing a C3+ NGL stream 34 with less than about 0.1 to 1.5 mole % ethane (which can form at least part of a Y-Grade NGL product stream 40) and a C2 enriched overhead stream 33. Such a deethanizer overhead 33 can be cooled using propane refrigeration in a heat exchanger 78 to a temperature ranging from about −37° C. (−35° F.) to about −41° C. (−42° F.), generating stream 35 which can be further chilled to about −43° C. to −54° C. (−45° F. to −65° F.) by heat exchanger 75 (that utilizes absorber overhead stream 30) to form stream 36. Stream 36 can be reduced in pressure, for example using a JT valve 79, and further chilled to form a cold reflux stream 41, at least a portion of which can be transferred to the absorber 73.

As noted above, overhead stream 30 produced by the absorber 73 can be utilized in a heat exchanger 75, which in turn forms stream 31. Stream 31 can, in turn, be utilized in a second heat exchanger 67 to form stream 37. Stream 37 can be compressed in compressor 81 to form compressed stream 38. This compressed stream 38 can subsequently be heated, for example using a reboiler 80, to form at least part of a Sales Gas stream 39.

Figure 2:
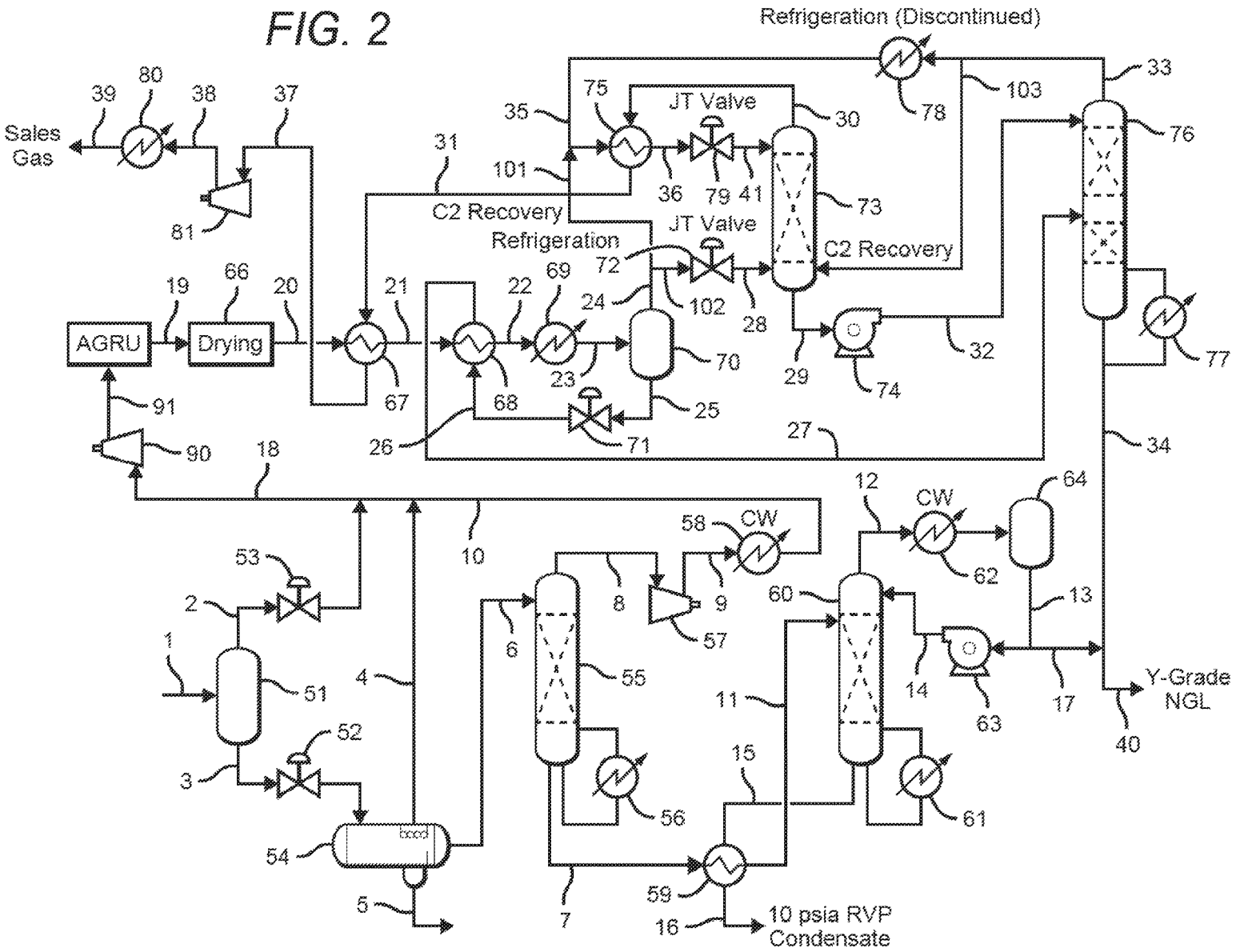
FIG. 2 schematically depicts an alternative system of the inventive concept, configured for recovery of ethane.

FIG. 2 depicts another embodiment of the inventive concept, in which a system or plant is configured for ethane (C2) rather than propane (C3) recovery. The flow of materials and product streams is similar to that depicted in FIG. 1. In such an embodiment at least a portion of the deethanizer overhead stream 33 can be redirected as stream 103 to the bottom of the absorber 73. The ethane content in stream 103 is reabsorbed by the subcooled liquid descending down through the absorber 73. During operation for ethane recovery, use of the reflux condenser 78 can be discontinued and flow 35 to the subcooler 75 can be stopped. In the feed portion of the system, the vapor stream 24 from separator 70 can be split into two portions, stream 101 and 102. Stream 101 can comprise from about 40 to 65% of the flow of vapor stream 24, and is cooled in subcooler 75 under pressure to form a subcooled methane rich liquid stream 36 that is letdown in pressure to the absorber 73. Subcooler 75 can use the absorber overhead vapor stream 30 for the subcooled liquid at a temperature of about −80° F. to −100° F., depending on the desired ethane recovery level. Such an arrangement typically can recover 40 to 60% or more of the ethane component in the feed gas. It should be appreciated that the system configuration shown in FIG. 2 can be adapted from the system configuration shown in FIG. 1 by the addition of additional piping, valves, and minor equipment. This advantageously permits an operator to simply and quickly reconfigure plant operation to switch between plant configurations for either propane or ethane recovery.

Figure 3:
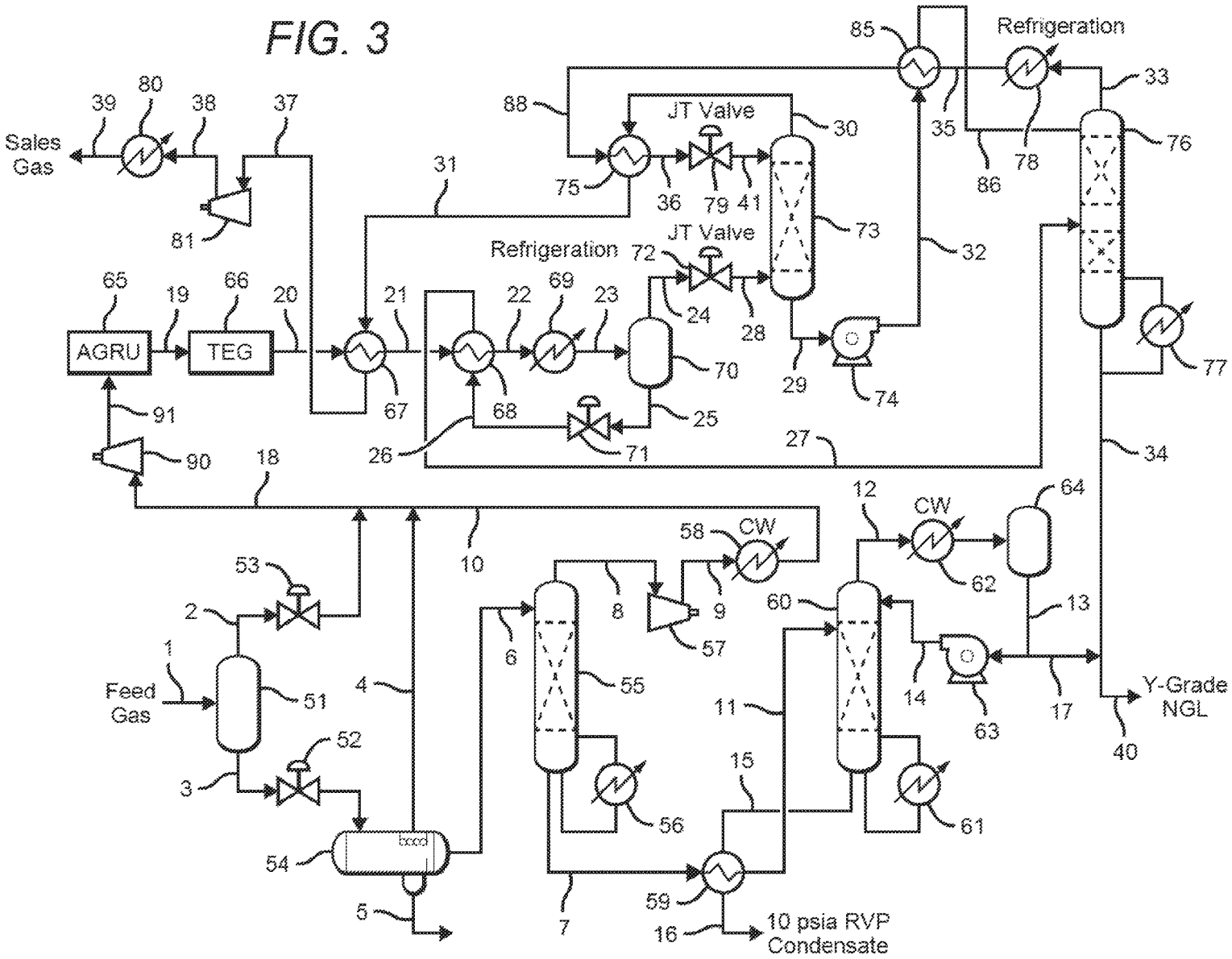
FIG. 3 schematically depicts another alternative system of the inventive concept.

Another embodiment of the inventive concept is depicted in FIG. 3, in which the flow of material is similar to that described for the system of FIG. 1. FIG. 3 depicts a system that can achieve even higher C3 recovery, which is accomplished when the cold absorber bottom stream 32 is used to chill the deethanizer overhead 33 through the use of an additional heat exchanger 85. This produces an even colder stream 88 prior to chilling by exchanger 75, which can be reduced in pressure (for example using a JT valve) and transferred to the absorber 73. It should be appreciated that this arrangement can be readily derived from the arrangement shown in FIG. 1 and/or FIG. 2 through the addition of pipes and a relatively straightforward valving arrangement. This advantageously permits an operator to simply and quickly reconfigure plant operation to switch between plant configurations for propane, ethane, or high efficiency propane recovery.

The material balance of an exemplary rich feed gas (i.e. stream 1) and of various process and product streams depicted in the exemplary system depicted in FIG. 1 is shown in FIG. 4; all values are in mol %. It should be appreciated that 95% C3 recovery can be achieved while meeting all desirable specifications with low specific power consumption (kW power/ton of propane product) and without the use of expensive and fragile turbo-expanders and brazed aluminum exchangers.

The material balance of an exemplary lean feed gas (i.e. stream 1) and of various process and product streams depicted in the exemplary configuration of FIG. 1 is shown in FIG. 5; all values are expressed as mol %. It should be appreciated that, even when provided with a lean feed gas having approximately half the propane content of a rich feed gas, the contemplated configurations and methods can achieve 85% C3 recovery while meeting all desirable specifications with low specific power consumption (kW power/ton propane product) and without the need for expensive and fragile turbo-expanders and brazed aluminum exchangers.

Figure 6:
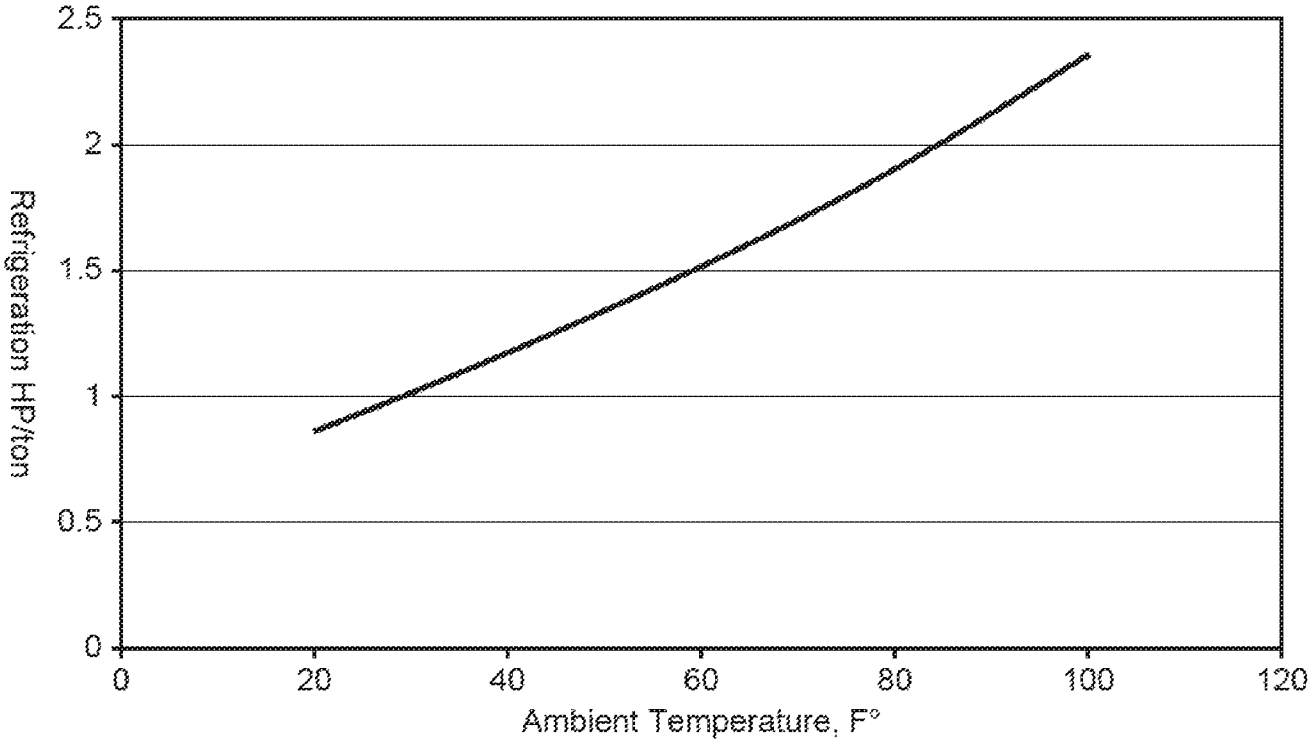
FIG. 6 is a graph depicting the relationship between ambient temperature and refrigeration efficiency for a propane refrigeration system.

The low power consumption of the contemplated methods is at least partially due to the high efficiency of propane (or equivalent) refrigeration, which is particularly true when such systems are operated under cold ambient conditions (as are frequently encountered in remote installations). In the embodiments depicted in FIGS. 1 and 2, propane refrigeration is used for chilling the inlet feed and the reflux stream from the deethanizer. The specific power consumption (HP/ton) of a refrigeration unit can be plotted against ambient temperatures, as shown in FIG. 6. Power consumption (in HP/ton) is about 2.3 when operating at 38° C. (100° F.) ambient temperature, but is reduced to 1.1 HP/ton when operating at 4° C. (40° F.) ambient temperature. Annual average specific power consumption of about 1.6 HP/ton can be expected under most operating conditions, and can be considerably lower in cold climates. It should be appreciated that the turbo-expander units utilized in prior art installation and methods are independent of ambient temperature and therefore cannot take advantage of the low ambient temperature conditions.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system configured to flexibly operate in a propane recovery mode or an ethane recovery mode, comprising:

a first separator configured to separate a mixed stream into a first vapor stream and a first liquid stream;

an absorber configured to receive the first vapor stream and to produce an absorber bottom stream and an absorber overhead stream; and a fractionation column configured to receive the first liquid stream and the absorber bottom stream and to produce a C3+ product stream and a fractionation column overhead stream;

a first heat exchanger, an absorber subcooler, and an expansion valve, wherein the first heat exchanger is coupled to the fractionation column and to the absorber subcooler, wherein the absorber subcooler is additionally coupled to the expansion valve and to the first separator, and wherein the expansion valve is additionally coupled to the absorber;

wherein the absorber is configured to receive the fractionation column overhead stream;

wherein the absorber is configured, during a propane recovery mode, to receive the fractionation column overhead stream at a top of the absorber as a reflux and the first vapor stream at a bottom of the absorber;

wherein the absorber is configured, during an ethane recovery mode, to receive the fractionation column overhead stream at the bottom of the absorber, a first portion of the first vapor stream at the bottom of the absorber, and a second portion of the first vapor stream at the top of the absorber as a reflux, wherein during a propane recovery mode and prior to the fractionation column overhead stream entering the absorber, the lint heat exchanger is configured to cool the fractionation column overhead stream, the absorber subcooler is configured to chill the fractionation column overhead stream, and the expansion valve is configured to expand the fractionation column overhead stream, wherein during ethane recovery mode and prior to the second portion of the first vapor stream entering the absorber, the absorber subcooler is configured to cool the second portion of the first vapor stream and the expansion valve is configured to expand the second portion of the first vapor stream.

2. The system of claim 1, wherein during propane recovery mode:

prior to the fractionation column overhead stream entering the absorber, the first heat exchanger is configured to cool the fractionation column overhead stream using propane refrigeration.

3. The system of claim 1, wherein during propane recovery mode:

prior to the fractionation column overhead steam entering the absorber, the absorber subcooler is configured to chill the fractionation column overhead stream using the absorber overhead stream.

4. The system of claim 1, wherein during ethane recovery mode:

prior to the second portion of the first vapor stream entering the absorber, the absorber subcooler is configured to cool the second portion of the first vapor stream using the absorber overhead stream.

5. The system of claim 1, wherein the first liquid stream is a C2+ enriched liquid fraction and the first vapor stream is a C2+ depleted vapor fraction during ethane recovery mode, and the first liquid stream is a C3+ enriched liquid fraction and the first vapor stream is a C3+ depleted vapor fraction during propane recovery mode.

6. A system configured to flexibly operate in a propane recovery mode or an ethane recovery mode, comprising:

a first separator configured to separate a mixed stream into a first vapor stream and a first liquid stream;

an absorber configured to receive the first vapor stream and to produce an absorber bottom stream and an absorber overhead stream;

a fractionation column configured to receive the first liquid stream and the absorber bottom stream and to produce a C3+ product stream and a fractionation column overhead stream;

wherein the absorber is configured to receive the fractionation column overhead stream;

wherein the absorber is configured, during a propane recovery mode, to receive the fractionation column overhead stream at a top of the absorber as a reflux and the first vapor stream at a bottom of the absorber;

wherein the absorber is configured, during an ethane recovery mode, to receive the fractionation column overhead stream at the bottom of the absorber, a first portion of the first vapor stream at the bottom of the absorber, and a second portion of the first vapor stream at the top of the absorber as a reflux, a second separator configured to separate a feed gas stream into a second vapor stream and a second liquid stream;

a third separator configured to separate the second liquid stream into a vapor portion and a hydrocarbon stream;

a stripper configured to strip the hydrocarbon stream to form a C2 rich vapor stream and a C2 depleted bottom stream;

a compressor configured to compress the C2 rich vapor stream to produce a compressed vapor stream; and a first heat exchanger configured to cool the compressed vapor stream to form a recycle stream;

wherein the mixed stream comprises the second vapor stream, the recycle stream, and the vapor portion of the second liquid stream.

7. The system of claim 6, further comprising:

a second heat exchanger, a third heat exchanger, and a fourth heat exchanger, wherein the second heat exchanger is coupled to the second separator and to the second heat exchanger, wherein the second heat exchanger is additionally coupled to the third heat exchanger, wherein the third heat exchanger is additionally coupled to first separator;

wherein during propane recovery mode and ethane recovery mode, the second heat exchanger is configured to cool the mixed stream using the absorber overhead stream;

the third heat exchanger is configured to cool the mixed stream using the first liquid stream; and the fourth heat exchanger is configured to cool the mixed stream using propane refrigeration.

8. The system of claim 7, wherein each of the first, second, third, and fourth heat exchanger comprises a shell and tube heat exchanger.

9. The system of claim 6, wherein the feed gas stream has an initial pressure of at least 100 psia, and wherein the mixed stream is cooled at a pressure between 500 psia and 1200 psia, and wherein the second vapor stream is expanded to a pressure of between 300 psig and 500 psig.

10. The system of claim 6, further comprising a stabilizer configured to fractionate the C2 depleted bottom stream into a C3+ NGL overhead fraction and a C5+ condensate bottom fraction; and a second heat exchanger configured to cool the C3+ NGL overhead fraction to form a C3+ NGL liquid stream;

wherein at least a portion of the C3+ NGL liquid stream is combined with the C3+ product stream to form a Y-Grade NGL stream.

11. The system of claim 1, further comprising a second expansion valve coupled to the first separator and to the fractionation column, wherein during propane recovery mode and during ethane recovery mode, the second expansion valve is configured to expand the first liquid stream prior to the first liquid stream entering the fractionation column.

12. The system of claim 1, wherein the reflux has a temperature between −34° C. (−30° F.) to −57° C. (−70° F.) during propane recovery mode.

13. The system of claim 1, wherein the reflux has a temperature between −51° C. (−60° F.) to −73° C. (−100° F.) during ethane recovery mode.

14. The system of claim 1, wherein the fractionation column is a non-refluxed column.

15. A system configured to flexibly operate in a propane recovery mode or an ethane recovery mode, comprising:

a first separator configured to separate a mixed stream into a first vapor stream and a first liquid stream, an absorber configured to receive the first vapor stream and to produce an absorber bottom stream and an absorber overhead stream;

a fractionation column configured to receive the first liquid stream and the absorber bottom stream and to produce a C3+ product stream and a fractionation column overhead stream;

wherein the absorber is configured to receive the fractionation column overhead stream;

wherein the absorber is configured, during a propane recovery mode, to receive the fractionation column overhead stream at a top of the absorber as a reflux and the first vapor stream at a bottom of the absorber;

wherein the absorber is configured, during an ethane recovery mode, to receive the fractionation column overhead stream at the bottom of the absorber, a first portion of the first vapor stream at the bottom of the absorber, and a second portion of the first vapor stream at the top of the absorber as a reflux, a second separator configured to separate a feed gas stream into a second vapor stream and a second liquid stream;

a third separator configured to separate the second liquid stream into a vapor portion and a hydrocarbon stream;

a stripper configured to strip the hydrocarbon stream to form a C2 rich vapor stream and a C2 depleted bottom stream;

a compressor configured to compress the C2 rich vapor stream to produce a compressed vapor stream; and a first heat exchanger configured to cool the compressed vapor stream to form a recycle stream;

wherein the mixed stream comprise the second vapor stream, the recycle stream, and the vapor portion of the second liquid stream;

a first valve configured to expand the first liquid stream; and a second valve configured to expand at least a portion of the first vapor stream.

16. The system of claim 15, further comprising:

a second heat exchanger, a third heat exchanger, and a fourth heat exchanger, wherein the second beat exchanger is coupled to the third separator and to the third heat exchanger, wherein the third heat exchanger is additionally coupled to the fourth heat exchanger, wherein the fourth heat exchanger is additionally coupled to first separator;

wherein the second heat exchanger is configured to cool the mixed stream using the absorber overhead stream;

wherein the third heat exchanger is configured to cool the mixed stream using the first liquid stream; and wherein the fourth heat exchanger is configured to cool the mixed stream using propane refrigeration.

17. The system of claim 15, further comprising:

a stabilizer configured to fractionate the C2 depleted bottom stream into a C3+ NGL overhead fraction and a C5+ condensate bottom fraction;

a second heat exchanger configured to cool the C3+ NGL overhead fraction to form a C3+ NGL liquid stream;

wherein at least a portion of the C3+ NGL liquid stream is combined with the C3+ product stream to form a Y-Grade NGL stream.

18. The system of claim 15, wherein the first valve is a first expansion valve, and wherein the second valve is a second expansion valve.

19. The system of claim 6, further comprising:

a first expansion valve configured to receive the fractionation column overhead stream and to expand the fractionation column overhead stream; and a second expansion valve configured to expand at least a portion of the first vapor stream.

20. The system of claim 1, further comprising a second expansion valve configured to expand the second portion of the first vapor stream.

* * * * *